US008291834B2

(12) United States Patent
Romero Font

(10) Patent No.: US 8,291,834 B2
(45) Date of Patent: Oct. 23, 2012

(54) TILTING, RETRACTABLE SCREEN DEVICE FOR TABLES

(75) Inventor: Montserrat Romero Font, Sant Hipolit de Voltrega (ES)

(73) Assignee: Albiral Display Solutions, S.L. (ES)

( * ) Notice: Subject to any disclaimer, the term of this patent is extended or adjusted under 35 U.S.C. 154(b) by 86 days.

(21) Appl. No.: 12/994,005

(22) PCT Filed: Apr. 29, 2009

(86) PCT No.: PCT/IB2009/051750

§ 371 (c)(1),
(2), (4) Date: Nov. 22, 2010

(87) PCT Pub. No.: WO2009/141744

PCT Pub. Date: Nov. 26, 2009

(65) Prior Publication Data

US 2011/0134522 A1 Jun. 9, 2011

(30) Foreign Application Priority Data

May 22, 2008 (ES) ..... 200801078 U
May 22, 2008 (ES) ..... 200801079 U

(51) Int. Cl.
*A47B 37/00* (2006.01)

(52) U.S. Cl. ..... 108/50.02

(58) Field of Classification Search ..... 108/50.01, 108/50.02, 147; 312/7.2, 223.3, 306, 309, 312/310, 319.5
See application file for complete search history.

(56) References Cited

U.S. PATENT DOCUMENTS

| | | | | |
|---|---|---|---|---|
| 3,229,695 | A * | 1/1966 | Kaufmann | 312/183 |
| 4,065,194 | A * | 12/1977 | Mattia | 312/247 |
| 4,766,422 | A * | 8/1988 | Wolters et al. | 312/198 |
| 5,401,089 | A | 3/1995 | Inagaki et al. | |
| 6,612,670 | B2 * | 9/2003 | Liu | 312/312 |
| 6,733,094 | B1 * | 5/2004 | Chang | 312/7.2 |
| 7,043,810 | B2 * | 5/2006 | Bober | 29/401.1 |
| 7,207,278 | B2 * | 4/2007 | Latino et al. | 108/50.01 |
| 7,735,432 | B2 * | 6/2010 | Jin et al. | 108/147 |
| 7,922,267 | B2 * | 4/2011 | Gevaert | 312/223.3 |

(Continued)

FOREIGN PATENT DOCUMENTS

ES 1057078 6/2004

(Continued)

OTHER PUBLICATIONS

International Search Report/Written Opinion for PCT International Application No. PCT/IB2009/051750 completed Jul. 21, 2010.

*Primary Examiner* — Jose V Chen
*Assistant Examiner* — Matthew Ing
(74) *Attorney, Agent, or Firm* — Barnes & Thornburg LLP

(57) ABSTRACT

A retractable tilted screen (2) device (1) for a desk (3) that is movable between a substantially vertical concealed position (A) in which the screen (2) is located below the surface of the desk (3) and a working position (B) in which the screen protrudes beyond, and tilts relative to, the surface of the desk (3). As the screen (2) is guided from the concealed position (A) to the working position (B), the screen moves vertically until it protrudes noticeably above the surface of the desk (3), and then the screen rotates to the working position. Hence, the screen can be used in a tilted position but remains in a vertical position when stored.

14 Claims, 5 Drawing Sheets

U.S. PATENT DOCUMENTS

2002/0101139 A1* 8/2002 Lee ..... 312/196
2004/0090154 A1 5/2004 Chang et al.
2004/0221775 A1* 11/2004 Okninski ..... 108/147
2006/0238086 A1 10/2006 Lai et al.
2007/0188056 A1* 8/2007 Chang ..... 312/7.2
2008/0060560 A1 3/2008 Chen et al.
2009/0102335 A1* 4/2009 Hancock et al. ..... 312/223.3
2009/0140615 A1* 6/2009 Freeman ..... 312/7.2

FOREIGN PATENT DOCUMENTS

ES 1061088 1/2006

* cited by examiner

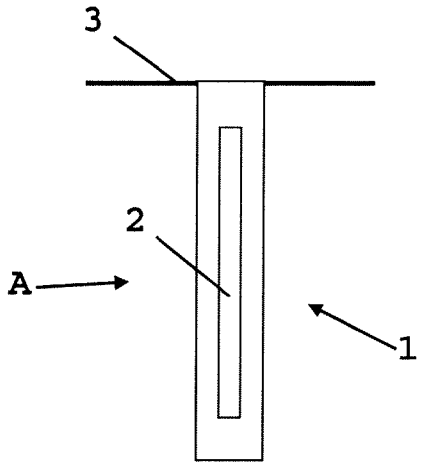
Fig. 1.a
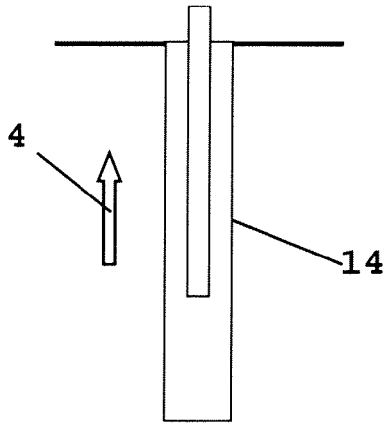
Fig. 1.b
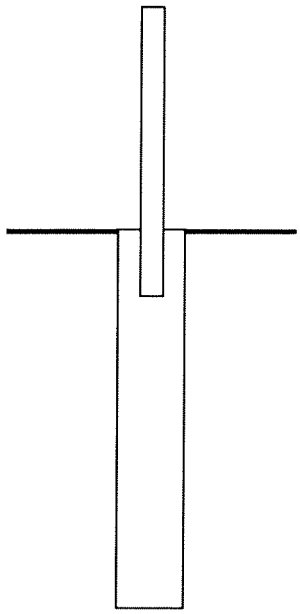
Fig. 1.c
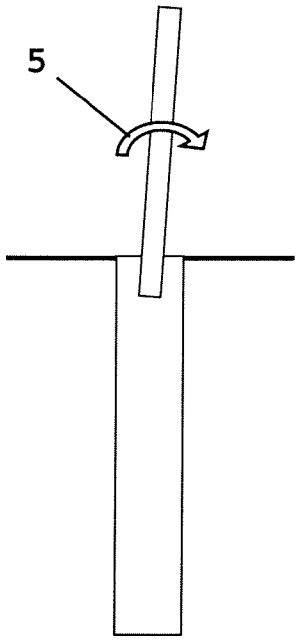
Fig. 1.d
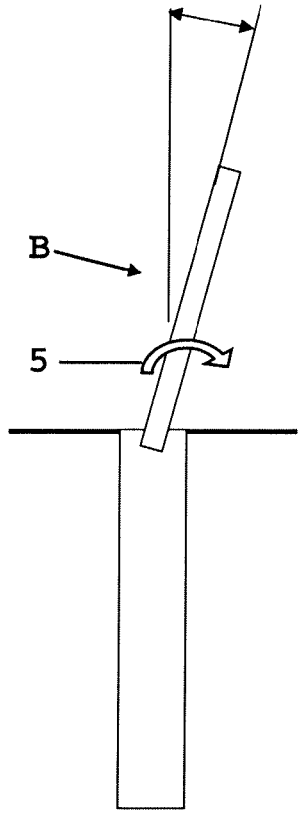
Fig. 1.e Fig. 2.a
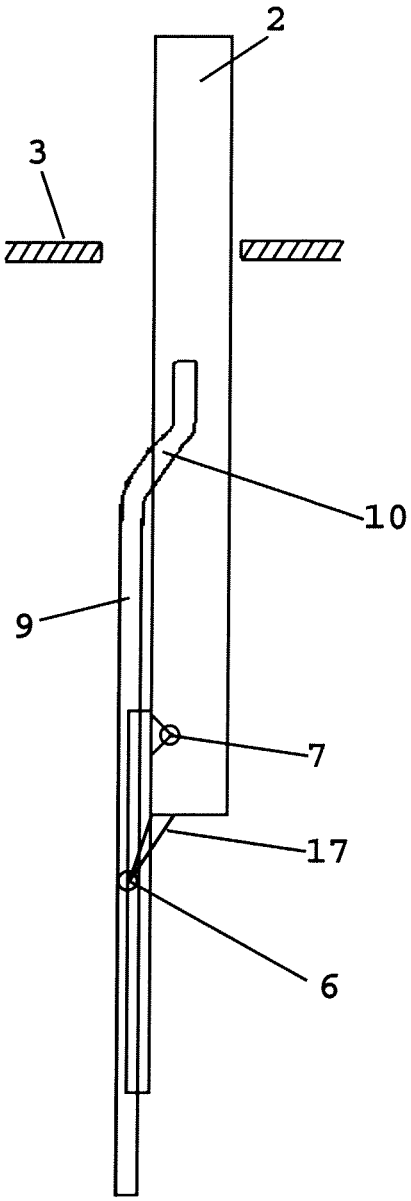
Fig. 2.b
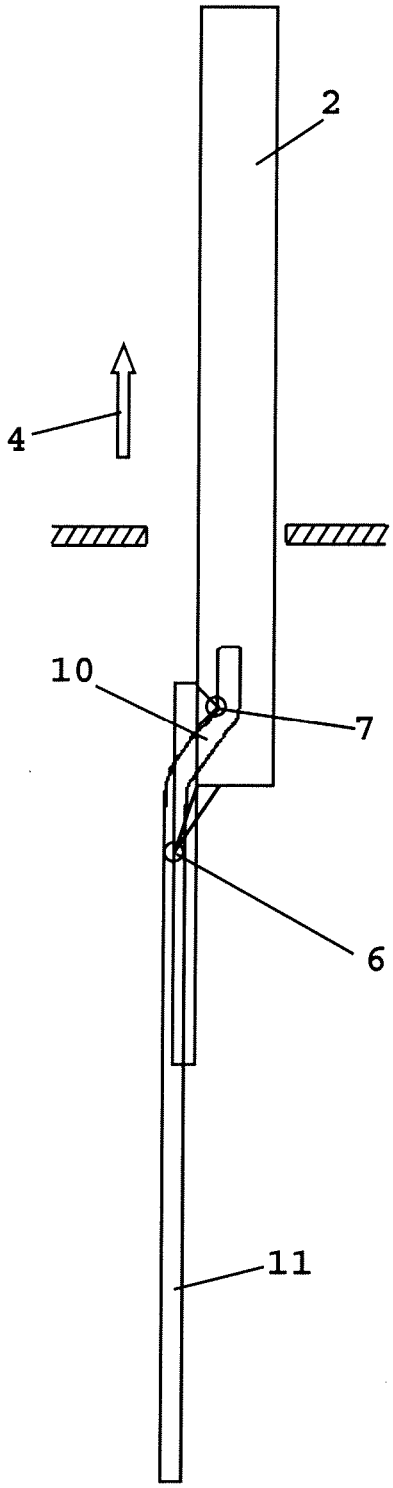

Fig. 2.c
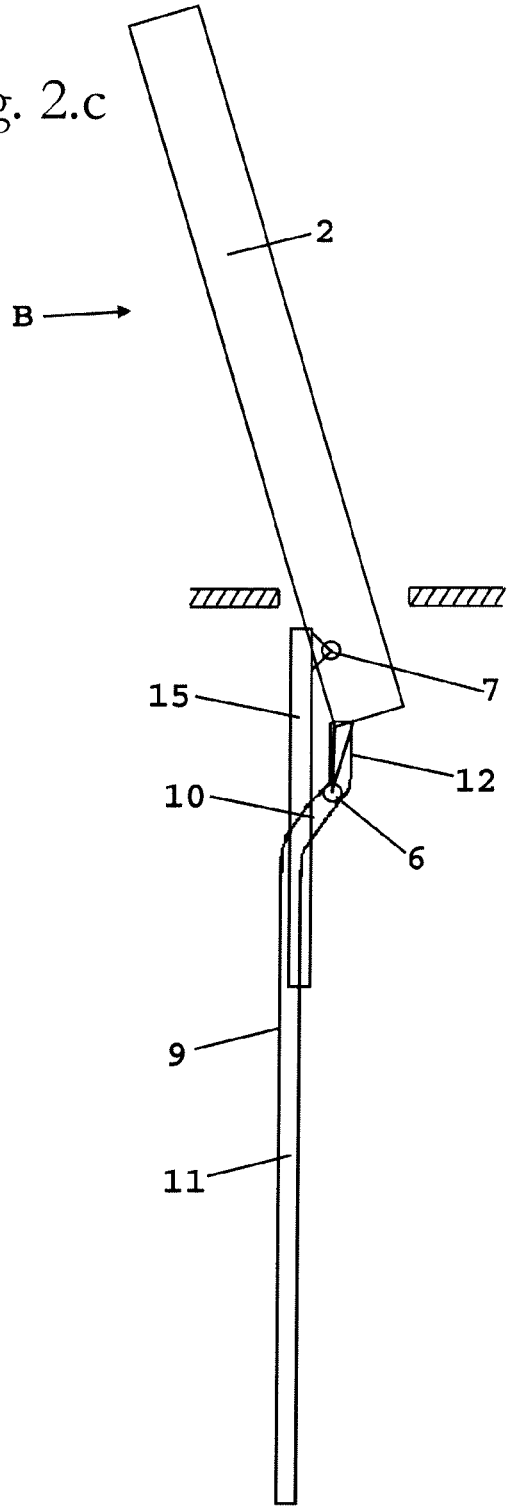
Fig. 2.d
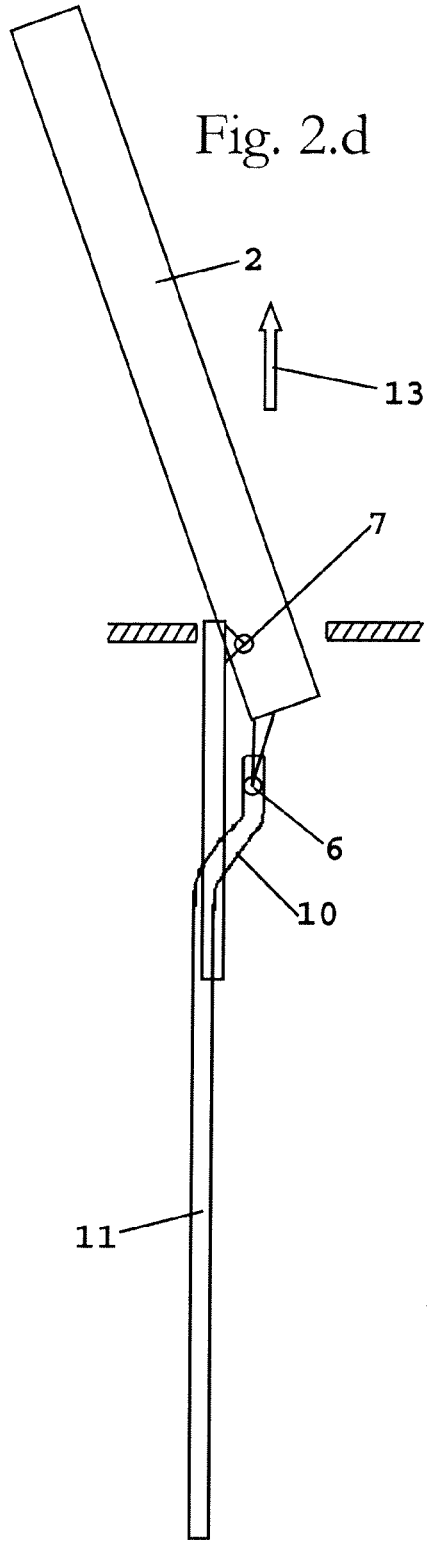

TILTING, RETRACTABLE SCREEN DEVICE FOR TABLES

CROSS-REFERENCE TO RELATED APPLICATIONS

This application is a U.S. national counterpart application of International Application Serial No. PCT/IB2009/051750 filed Apr. 29, 2009, which claims priority to Spanish Patent Application No. U0200801078 filed May 22, 2008 and Spanish Patent Application No. U0200801079 filed May 22, 2008. The disclosures of PCT/IB2009/051750, U0200801078, and U0200801079 are all hereby incorporated herein by reference.

The present invention relates to a retractable tilted screen device for desks, which optimizes space utilization while being convenient to use for users.

BACKGROUND OF THE INVENTION

There are some known retractable screen devices for desks comprising means for guiding the screen between a vertical concealed position wherein the screen is housed below the surface of the table and a working position wherein the screen protrudes beyond said surface, which are designed to adapt the use of working desks and to protect the screens.

Typically, these devices comprise a housing which houses the screen and the sliding mechanism of the screen between the two positions and is arranged under the desk.

This housing has the disadvantage of occupying a space under the table which may be uncomfortable for the user whose leg-space is reduced.

Another solution is to dispense with the tilt of the screen when being used, but the disadvantage is that the user's line of vision is not perpendicular to the plane of the screen and eye contact with others is reduced, with the discomfort this entails.

A solution to the viewing angle problem is to rotate the entire screen-mechanism-housing assembly around an axle situated approximately at the level of the opening, as proposed in European patent application EP 1574150, however, it does not solve the leg-space problem under the desk.

On the other hand, these devices generally comprise a lid to close the opening, designed to keep the housing closed when the screen is hidden, especially to provide a desk without inconvenient holes in the surface when the screens are not being used and to avoid dust or any object entering when the screen is not in use.

A common solution is a lid hinged to the desk that opens driven by the screen itself when it emerges. However, this solution has several disadvantages:

- The contact forces between the lid and the screen, namely the screen frame, can cause scratches on the frame and also friction noises that may be annoying.
- The lid is visible when the screen is in working position, which is unsightly because it involves a visible part of a mechanism on the desk, and highlights the utilitarian nature of the screen, unwanted features when optimization of the visual atmosphere is sought.

Therefore, a retractable screen device that solves the problems described is needed, namely, that both in extreme positions and in positions taken when in movement, the screen should take up as little space as possible under the table to avoid invading the leg-space, while providing the desired inclination of the screen when in working position. On the other hand, the present invention also aims to provide a retractable screen device that has a lid which does not brush against the screen when it opens and is hidden when in working position.

DESCRIPTION OF THE INVENTION

To that end, this invention provides a retractable screen device for desks, comprising means for guiding the screen between a substantially vertical concealed position whereby the screen is situated below the desk surface and a working position whereby the screen protrudes beyond the surface, and is characterized in that the guide means are configured to guide the desk in a movement that takes the screen from the concealed position to a working position which is inclined in relation to the desk surface, said movement being formed by a vertical translation until the screen protrudes noticeably beyond the surface followed by a rotation that takes the screen to the working position.

This sequence of movements solves the technical problems, since it tilts the screen into its working position and on the other hand, allows the screen and its housing to be stored in a vertical position.

Preferably, the inclination corresponding to the working position is of about 20 degrees, optimum angle when the screen is arranged with its underside substantially at the level of the desk surface.

Advantageously, the guide means comprise two horizontal axles joined to the screen, being located one below the other, a pair of upper axle guides that guide it according to a substantially vertical movement and at least another pair of lower axle guides that guide it according to a movement with vertical and horizontal components in the final upward stretch, so the upward movement of the screen causes it to tilt.

This configuration allows a twist at the end of the upward movement of the screen (or equivalently, at the beginning of the downward movement) and a translational movement during the rest of the trajectory.

More preferably, the pair of lower axle guides comprise a section near the surface of the desk which is tilted as regards to a lower section, which is substantially vertical, so that the screen tilts back, pivoting on the upper axle in a rotational movement, when the ends of the lower axle slide along the section of such guides which is near the surface.

More advantageously, the screen can pivot with respect to a support according to such upper axle, so that this support transmits the efforts between the various parts, including the drive motor, and enables the easy removal of the screen for maintenance or replacement More advantageously, the lower axle guides comprise a last section substantially aligned with the lower section, so that the displacement at the end of the trajectory is substantially translational.

Therefore, once the screen is tilted, it can still go an extra length without changing its inclination. This allows in particular simplifying the upward drive control, since no great accuracy is needed to deactivate the vertical displacement drive motor. Indeed, when reaching the working position, the screen takes speed and therefore has some kinetic energy. If the guide were to end at that point, either a motor control would be needed allowing reversing its rotational direction in a short time, or there would be an impact between the axle ends and the guide end. Therefore, the extension of the guide allows the screen to lose some kinetic energy by the action of gravity and also allows a less precise control system, that is, at a lower cost than that needed to stop the screen in a shorter trajectory.

More preferably, the device comprises a screen protection housing attached to the underside of the desk.

Additionally, the said support comprises four wheels that roll along such guides of the upper axle, so that these wheels and the support form a link between these guides and the upper axle guiding it according to a vertical movement. Cooperation between the four wheels and the upper axle guides ensure a smooth run of the upper axle in its vertical translational motion, and avoid ill linking conditioning.

On the other hand, the device of the present invention comprises a lid closing said opening and means for moving the lid between a closed position and a retracted position whereby said lid is situated below the desk surface.

This feature solves some of the disadvantages of prior art, since the lid is only visible when closed and if an object is accidentally placed on top, the lid will not put pressure on the object as it will withdraw into position without protruding beyond the plane of the desk, it being the mechanism for lifting the screen, much more robust, which will put pressure on the object.

Preferably, in this closed position the lid is substantially flush with the plane of the desk surface so that the desk has the whole of its working surface available when the screen is not in use, and furthermore has no parts in relief which could be unsightly.

Advantageously the means for moving the lid comprise a hinge axle between the lid and the desk, this axle being located close to one edge of the opening and below the level thereof, an articulated rod with an appendix joined to the lid so that movement of the rod induces a rotation of the lid, and linking means between the movement of the screen and the movement of the rod, so that the lid retracts shortly after the beginning of the ascent of the screen and closes just before the end of the descent of the screen.

This is accomplished by a simple mechanism in which there are no contact forces between the screen frame and lid, thus avoiding scratches, and allowing fine materials to be used for the screen frame, such as wood, etc.

More preferably, the linking means between the screen movement and the movement of the rod comprise a mounted slide along the rod and which rotates on an axle joined to the screen and provided with means to perform a drag force on the rod for an upward or downward stretch of the screen.

More advantageously, the means for performing a drag force on the rod comprise a widening of the rod and a sliding mounted element on the slide driven by a spring toward the rod, the spring constants being determined so that when the element is at the level of the widening, the normal force exerted by the element on the rod causes an upward or downward frictional drag force, and when it is above the widening, it does not make contact with the rod.

This system allows the slide, dragged by the screen itself, to activate the rod movement just enough to make the lid open and close.

More advantageously, the device comprises means to stabilize the lid position in the closed position and in the retracted position. Such means, which can be performed with a stable spring mechanism in the two positions, a set of magnets, or an imbalance between the lid and rod weights, guarantees the stability of the lid in each of the two resting positions, in the first two cases, or only the opening position in the third.

BRIEF DESCRIPTION OF THE DRAWINGS

For a better understanding of what has been stated some drawings which, schematically and solely by way of example, show a practical embodiment.

FIGS. 1.*a* to 1.*e* are elevational views which represent the relative position of the screen and the desk at different times of the upward or downward movements.

FIGS. 2.*a* to 2.*d* are elevational views of the device of the invention which shows the relative arrangement of its main components when the screen goes through the different positions.

DESCRIPTION OF PREFERRED EMBODIMENTS

Figure 3:
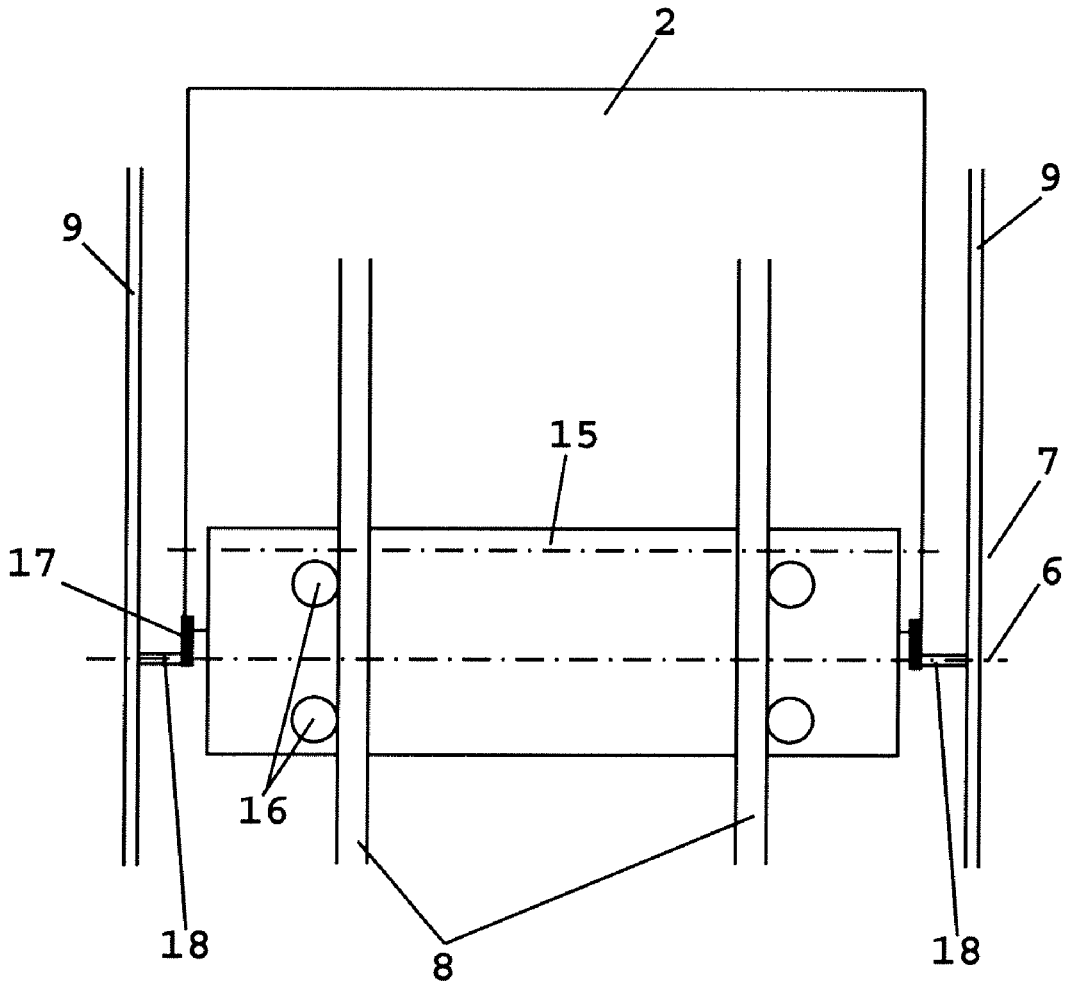
FIG. 3 depicts a rear elevational view of the lid mechanism of the device of the invention.

As shown by FIGS. 1.*a* to 1.*e* and 2.*a* to 2.*d*, the invention relates to a retractable screen 2 device 1 for desks 3, provided with means for guiding the screen between a significantly vertical concealed position A where the screen 2 is below the desk surface 3, preferably housed in a protective housing 13, and a working position B in which the screen 2 protrudes above the surface of the desk and is characterized in that the guide means are configured to guide the desk in a movement that takes the screen from a concealed position A to a working position B which is tilted as regards to the surface of the desk 3, preferably with an $\alpha$ angle of about 20 degrees, while said movement is formed by a vertical translation 4 until the screen 2 protrudes noticeably above the surface followed by a rotation 5, which takes the screen to the working position, thus enabling a comfortable viewing of the screen and maximum leg-space, as the pivoting with respect to the desk occurs with respect to an axle located on the underside of the screen, whereby it hardly takes up any space in front of the screen.

According to a preferred embodiment of the invention, as shown in FIGS. 2.*a* to 3, the movement means of the screen include two horizontal axles 6 and 7 joined to the screen 2, one 6 being situated below the other 7, a pair of guides 8 of the upper axle 7 that guide it according to a substantially vertical movement and at least another pair of guides 9 of the lower axle 6 that guide it according to a movement with vertical and horizontal components, so that the upward movement of the screen 2 causes it to tilt.

The movement with the vertical and horizontal components is accomplished in the present embodiment through the lower axle guides 9, which consist of a section 10 near the surface of the desk 3 tilted with respect to a lower section 11, which is substantially vertical so that the screen 2 is tilted backwards, rotationally 5 pivoting on the upper axle 7, when the ends 18 of the lower axle 6 slide down said section 10 of said guides 9 near the surface.

The translational movement of the upper axle 7 is accomplished by mounting the latter on a support 15 having only one degree of free movement which is vertical. Therefore, the screen and support are articulated through the upper axle 7.

To guide the upper axle 7 in vertical translation, the support 15 comprises four wheels 16 that roll along such guides 8 of the upper axle 7 so that these wheels and support are a link between the guides 8 and the upper axle that guide it according to a vertical movement. By providing 2 wheels on each guide 8, this prevents the rotation of the screen according to an axle perpendicular to the screen itself and therefore any rigidity between the support 15 and said guides 8

Another advantageous feature of this preferred embodiment is that the guides 9 have a last section 12 substantially aligned with the lower section 11, so that the displacement 13 is substantially translational at the end of the trajectory. Indeed, once the lower axle 6 has passed the inclined section, it begins to slide along this last stretch 12 which is parallel to section 11 along which the axle 6 continues to slide, so that the screen has a final movement that does not change the tilt. Therefore, the screen need not be immobilized when it has reached its tilted position, as it has a section without needing an accurate control, which would be expensive, ensuring the smooth operation of the device.

Also, the device of the invention comprises a control system, already known in itself, which includes an adapter card that controls the entries and exits to control the position of the screen using a microcontroller. These entries can be connected to position photocells and, preferably, the speed control in the upward movement involves a slow beginning, then changing to the normal speed, and when the lower axle enters the tilted section it goes back to a slow speed. The downward movement is equivalent but in reverse. The slow movements avoid sudden changes in the speed of the screen support assembly, particularly at the ends of the guides, where there is a greater risk of impact and therefore stress that may damage the device. Also, to avoid overexertion, the device of the invention may comprise an automatic shutdown system depending on the resistance detected in the upward or downward movements The device can be controlled by means of two buttons, one for going up and one for going down, mounted on the side of the opening, preferably on the right-hand side, and likewise each of them can be the stop button while the other has been pressed. Another alternative is to control it with a remote control or automation, such as AMX, Creston, or any other adapted to the device.

Figure 4:
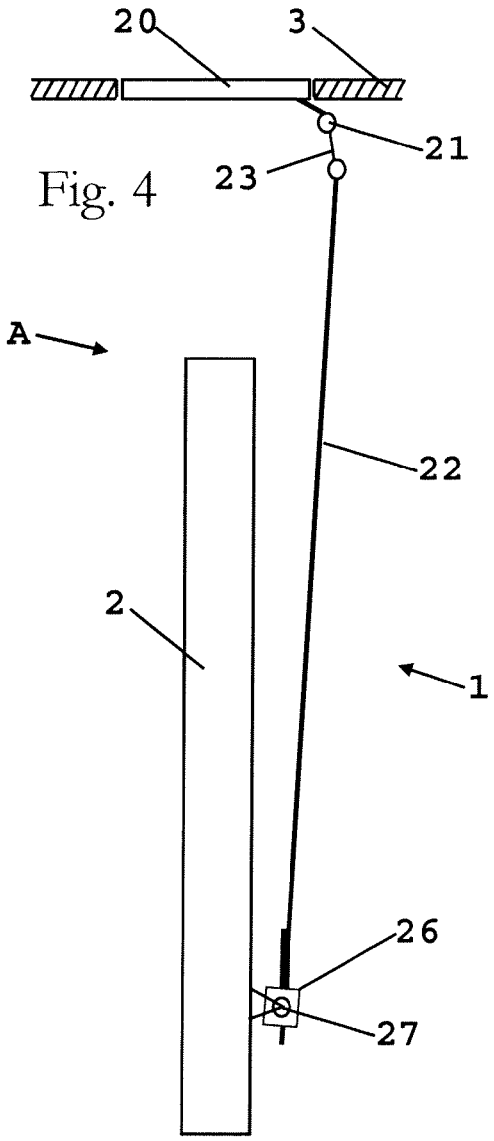
FIG. 4 is a schematic elevational view of the lid mechanism of the device of the invention when the screen is in a concealed position.
Figure 5:
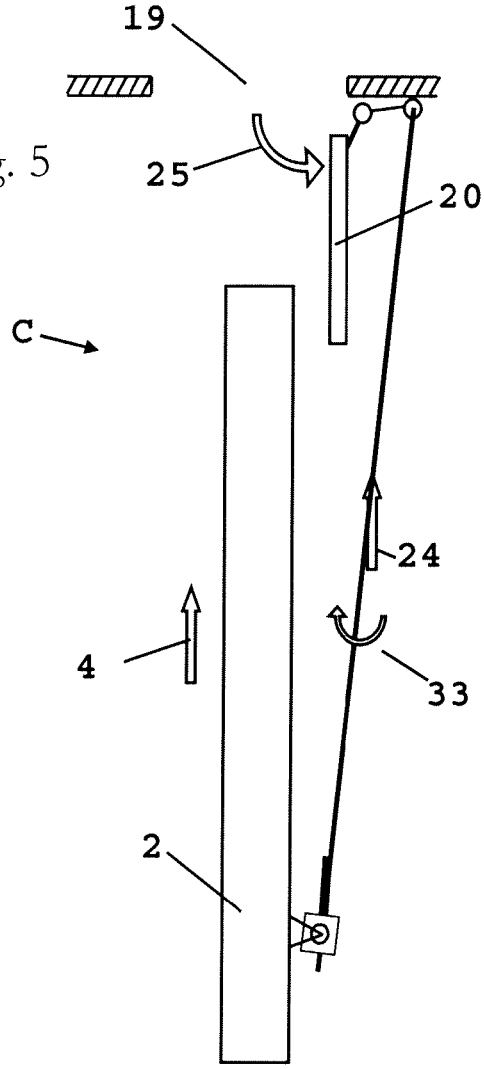
FIG. 5 is a schematic elevational view of the lid device of the invention when the screen is in a working position.

On the other hand, as shown in FIGS. 4 and 5, the device 1 of the preferred embodiment is provided with a lid 20 to close the opening 19 of said desk 3 and means for moving between a closed position A and a retracted position C that allows the passage of the screen 2, and specifically in the device of the invention, the retracted position is located below the surface of the desk 3, as shown in FIG. 5. Therefore, to take it from the closed position A, in which, as shown in FIG. 4 the lid 20 is flush with the plane of the surface of the desk 3, to the retracted position C, it does not need at any time to protrude beyond the plane of the desk 3, whereby the movements of the lid 20 are not impeded by objects that can be found inadvertently on the desk 3.

According to the preferred embodiment of the invention, as shown in FIGS. 4 and 5, to move the lid 20 between the two positions A and C, the device 1 comprises a hinge axle 21 between the lid 20 and the desk 3 located close to an edge of the opening 19 and below the level thereof, a rod 22 articulated with an appendix 23 joined to the lid 5.

Specifically, these elements are arranged so that the movement 24 of the rod 22 induces a rotation 25 of the lid 20, and linking means between the movement 4 of the screen 2 and the movement 24 of the rod 22, so that the lid 20 withdraws soon after the screen 2 starts to rise and closes shortly before the end of the descent of the screen 2. This mechanism is very simple and reliable and prevents contact between the lid 20 and the screen 2.

In this preferred embodiment, the linking means between the movement 4 of the screen 2 and the movement 24 of the rod 8 comprise a mounted slide 26 along the rod 22 and rotating on an axle 27 joined to the screen 2 and provided with means for dragging the rod 22 during an upward 32 or downward 31 trajectory of the screen 2.

Axle 27 joined to the screen, means that the movement of one implies that of the other according to a rigid body kinematics, but does not necessarily imply a direct binding of the joint axle 27 to the screen 2, yet rather preferably, both screen 2 and axle are fixed to a sturdy support responsible for driving the screen.

Thus, by activating the screen 2 elevation, the slide 26, whose axle of rotation 27 is joined to the screen 2, pushes the rod 22 upwards, and the latter will trigger the rotation of the lid 20.

The displacement of the lid 20 between its two extreme positions is achieved with a minimum displacement of rod 22 end, determined mainly by the length of said appendix 23.

Therefore, it is only necessary for the slide 26 to activate the axle 22 during a stretch of the upward or downward trajectory. This is achieved with the rod 22 dragging means that are built into the slide 26.

Figure 6:
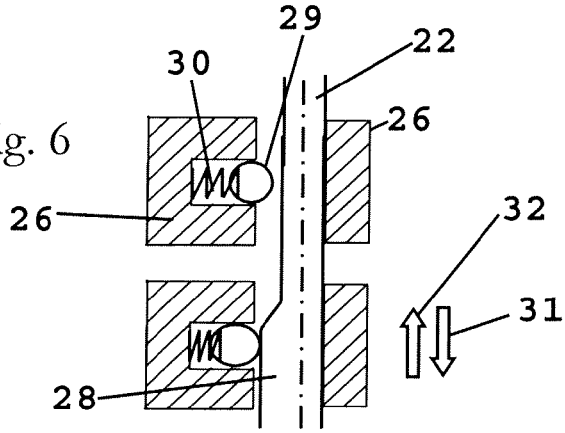
FIG. 6 is a schematic section of part of the rod and slide in a situation where there is pressure and hence friction and in another where there is no contact.

As illustrated in FIG. 6, according to the preferred embodiment described, the means for performing a drag force on the rod 22 include a widening 28 of the rod 22 and a mounted sliding element 29 on the slide 26 driven by a spring 30 toward the rod 22, the spring 30 constants being determined such that when the element is at the height of the widening 28, the normal force exerted by the element 29 on the rod 22 causes an upward 32 or downward 31 frictional drag force, and when it is above the widening 28, it does not come into contact with the rod 22.

FIG. 6, for the sake of simplicity, shows a widening 28 whose section is offset with respect to the rod section 22 immediately above.

This simple mechanism means that, in the extreme positions of the lid 20, i.e. the end of the appendix, the movement of the end of the rod 22 is prevented, and the friction force between the rod 22 and the element 29 and the larger section stretch, either upward 31 or downward 32, is strong enough to move the rod 22 in the opposite direction to that where it is blocked.

FIG. 6 shows the relative positions that may exist between the rod 22 and the slide 26. Specifically, when the slide 26 is in the lower position shown, whether going up or down, it drags the rod 22 upwards or downwards respectively, then opening or closing the lid 20 of the opening 19. When in the upper position, it is noted that the resting length of the spring 30 is determined such that the element 29 fails to make contact with the rod 22. Obviously, the widening 28 is very short, since a minimum run is needed to produce a rotation of the lid 20.

On the other hand, since the lid-appendix assembly revolves around an axle 21, the rise of the end of the appendix 23 which is attached to the rod 22 also involves a sideways movement, which induces the rod 22, apart from the upward movement 24, to rotate 33. Hence the need to provide the slide 26 with a degree of freedom of rotation with respect to the screen 2. This degree of freedom is provided by the rotation axle 27 between the slide 22 and the screen 2.

In addition to providing stability in the extreme positions, the device of the invention comprises means to stabilize the position of the lid 20 in the closed position A and in the retracted position C, for example by a spring mechanism stable in both positions or a set of magnets, one in the lid 20 and another fixed to the desk 3 in the vicinity of the first when the lid 20 is open.

Stability in the open position C can also be achieved with a mass difference between the lid 20 and the rod 22 causing an imbalance of moments that tend to leave the lid 20 in a retracted position C.

The invention claimed is:

1. A retractable tilted screen (2) device (1) for a desk (3) comprising guide means for guiding the screen (2) between a substantially vertical concealed position (A) wherein the screen (2) is located below an upper surface of the desk (3) and a working position (B) wherein the screen (2) protrudes beyond, and tilts relative to, the upper surface, wherein said guide means are configured to guide the screen (2) to move vertically from the concealed position (A) to protrude at least halfway beyond the upper surface and then tilt toward the working position (B); and (ii) said guide means comprises a lower axle (6) joined to the screen, an upper axle (7) joined to the screen above the lower axle, a pair of upper axle guides (8) that guide the upper axle (7) to move substantially vertically, and pair of lower axle guides (9) each having an upper section (10) to guide the lower axle (6) to move diagonally, so that upward movement of the screen (2) causes the screen (2) to tilt.

2. The retractable tilted screen device (1) according to claim 1, wherein the screen tilts approximately 20 degrees when in the working position (B).

3. The retractable tilted screen device (1) according to claim 1, wherein the device (1) comprises a housing (14) fixed to an underside of the desk (3) to protect the screen (2).

4. The retractable tilted screen device (1) according to claim 1, wherein the upper section (10) is tilted with respect to a substantially vertical lower section (11), so that the screen (2) pivots backwards about the upper axle toward the working position when the lower axle (6) slides along the upper section (10).

5. The retractable tilted screen device (1) according to claim 4, wherein said lower axle guides (9) each include a last section (12) aligned with the lower section (11), so that the screen moves linearly into the working position (B).

6. The retractable tilted screen device (1) according to claim 4, wherein the screen (2) is configured to pivot about the upper axle relative to a support.

7. The retractable tilted screen device (1) according to claim 6, wherein said support (15) comprises four wheels (16), each wheel having an axle perpendicular to a general plane of movement of the wheels (16), said wheels rolling along the upper axle guides, such that the support connects the upper axle guides (8) and the upper axle (7), said upper axle guiding the screen to move vertically.

8. The retractable tilted screen device (1) according to claim 1 comprising an opening (19) in the desk (3), a lid (20) of said opening (19), and closure means for moving the lid (20) between a closed position (A) and a retracted position (C), wherein the retracted position allows the screen to move, wherein the lid is below the upper surface when in the retracted position (C).

9. The retractable tilted screen device (1) according to claim 8, wherein in said closed position (A) the lid (20) is substantially flush with the plane of the upper surface.

10. The retractable tilted screen device (1) according to claim 8, wherein the closure means comprises a hinge axle (21) between the lid (20) and the desk (3), said hinge axle (21) being adjacent and below an edge of the opening (19), a rod (22) articulated with an appendix (23) joined to the lid (20) such that moving the rod (22) rotates the lid (20), and linking means that retract the lid after the screen begins rising and that close the lid before the screen stops descending.

11. The retractable tilted screen device (1) according to claim 10, wherein the linking means comprises a mounted slide (26) along the rod (22), said mounted slide rotating about a slide axle (27) joined to the screen (2), said mounted slide having drag means for exerting a drag force on the rod (22) as the screen moves up or down.

12. The retractable tilted screen device (1) according to claim 11, wherein said drag means comprises a widening (28) of the rod (22) and a mounted sliding element (29) on the mounted slide (26), said mounted sliding element being driven towards the rod (22) by a spring (30), the spring having a spring constant such that when the mounted sliding element is at the height of the widening (28), a normal force exerted by the mounted sliding element (29) on the rod (22) causes an upward or downward frictional drag force, and when the mounted sliding element (29) is above the widening (28), the mounted sliding element (29) does not contact the rod (22).

13. The retractable tilted screen device (1) according to claim 8, comprising stabilizing means to stabilize the position of the lid (20) in the closed position (A) and in the retracted position (C).

14. The retractable tilted screen device (1) according to claim 13, wherein said stabilizing means comprises a stable spring mechanism in two positions or a set of magnets.

* * * * *